US009789506B2

(12) United States Patent
Kosta

(10) Patent No.: US 9,789,506 B2
(45) Date of Patent: Oct. 17, 2017

(54) HOLDER ASSEMBLY

(71) Applicant: Spiro Kosta, Eddystone, PA (US)

(72) Inventor: Spiro Kosta, Eddystone, PA (US)

( * ) Notice: Subject to any disclaimer, the term of this patent is extended or adjusted under 35 U.S.C. 154(b) by 0 days.

(21) Appl. No.: 14/557,543

(22) Filed: Dec. 2, 2014

(65) Prior Publication Data

US 2016/0151800 A1 Jun. 2, 2016

(51) Int. Cl.
*B05B 15/06* (2006.01)
*B05B 12/00* (2006.01)
*B05B 7/02* (2006.01)

(52) U.S. Cl.
CPC ..... *B05B 15/064* (2013.01); *B05B 12/002* (2013.01); *B05B 7/02* (2013.01)

(58) Field of Classification Search
CPC ... B05B 15/061; B05B 15/064; B05B 12/002; B05B 7/02
USPC ..... 239/352, 526, 529, 530, 531; 294/26, 294/175, 82.1–191, 27.1–34
See application file for complete search history.

(56) References Cited

U.S. PATENT DOCUMENTS 1,511,361 A * 10/1924 Paasche ..... B05B 15/061 222/174
1,745,972 A * 2/1930 Beck ..... B05B 15/064 239/532
2,122,559 A * 7/1938 Dapero ..... B05B 1/267 138/30
3,915,382 A * 10/1975 Davis ..... B05B 15/064 239/195
4,023,711 A 5/1977 Sena
4,457,472 A * 7/1984 Geberth, Jr. ..... B05B 15/064 239/281
4,744,519 A * 5/1988 Crowley ..... B05B 15/064 239/532
4,789,084 A * 12/1988 Yoshitomi ..... B05B 15/064 222/174
D333,095 S 2/1993 Haubner
5,485,960 A * 1/1996 Troudt ..... B05B 15/064 239/532
5,496,123 A 3/1996 Gaither
6,450,423 B1 * 9/2002 Gurule ..... B65D 83/203 222/174
6,547,165 B2 4/2003 Goodwin et al.
7,040,510 B1 5/2006 Hester
7,216,906 B2 * 5/2007 Barrett ..... F16B 45/025 294/210
7,455,469 B1 11/2008 Langdon
7,677,476 B2 3/2010 Burdsall et al.
7,717,300 B1 * 5/2010 Yarrusso, Jr. ..... A01M 1/2038 222/174
8,398,134 B1 * 3/2013 Mortensen ..... B66F 19/00 248/925

(Continued)

*Primary Examiner* — Arthur O Hall
*Assistant Examiner* — Adam J. Rogers
(74) *Attorney, Agent, or Firm* — Gerry J. Elman; Elman Technology Law, P.C.

(57) ABSTRACT

A holder assembly includes a pole has an upper section and a lower section. An engaging member is coupled to the upper section. The engaging member may retain a paint gun on the pole. A connector is coupled to the pole such that the connector is positioned proximate a distal end of the pole with respect to the engaging member. A trigger is movably coupled to the connector. A cord extends between the paint gun and the trigger. The trigger may actuate the paint gun when the trigger is actuated.

10 Claims, 4 Drawing Sheets

(56) References Cited

U.S. PATENT DOCUMENTS

| | | | | |
|---|---|---|---|---|
| 2002/0134864 | A1* | 9/2002 | Goodwin | B05B 12/00 239/532 |
| 2007/0122227 | A1 | 5/2007 | Davis | |
| 2007/0170288 | A1* | 7/2007 | Troudt | B05B 15/064 239/587.5 |
| 2011/0017846 | A1* | 1/2011 | Baxter | B05B 15/066 239/587.1 |

* cited by examiner

HOLDER ASSEMBLY

BACKGROUND OF THE DISCLOSURE

Field of the Disclosure

The disclosure relates to holder devices and more particularly pertains to a new holder device for coupling a paint gun to an extension pole.

SUMMARY OF THE DISCLOSURE

An embodiment of the disclosure meets the needs presented above by generally comprising a pole has an upper section and a lower section. An engaging member is coupled to the upper section. The engaging member may retain a paint gun on the pole. A connector is coupled to the pole such that the connector is positioned proximate a distal end of the pole with respect to the engaging member. A trigger is movably coupled to the connector. A cord extends between the paint gun and the trigger. The trigger may actuate the paint gun when the trigger is actuated.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
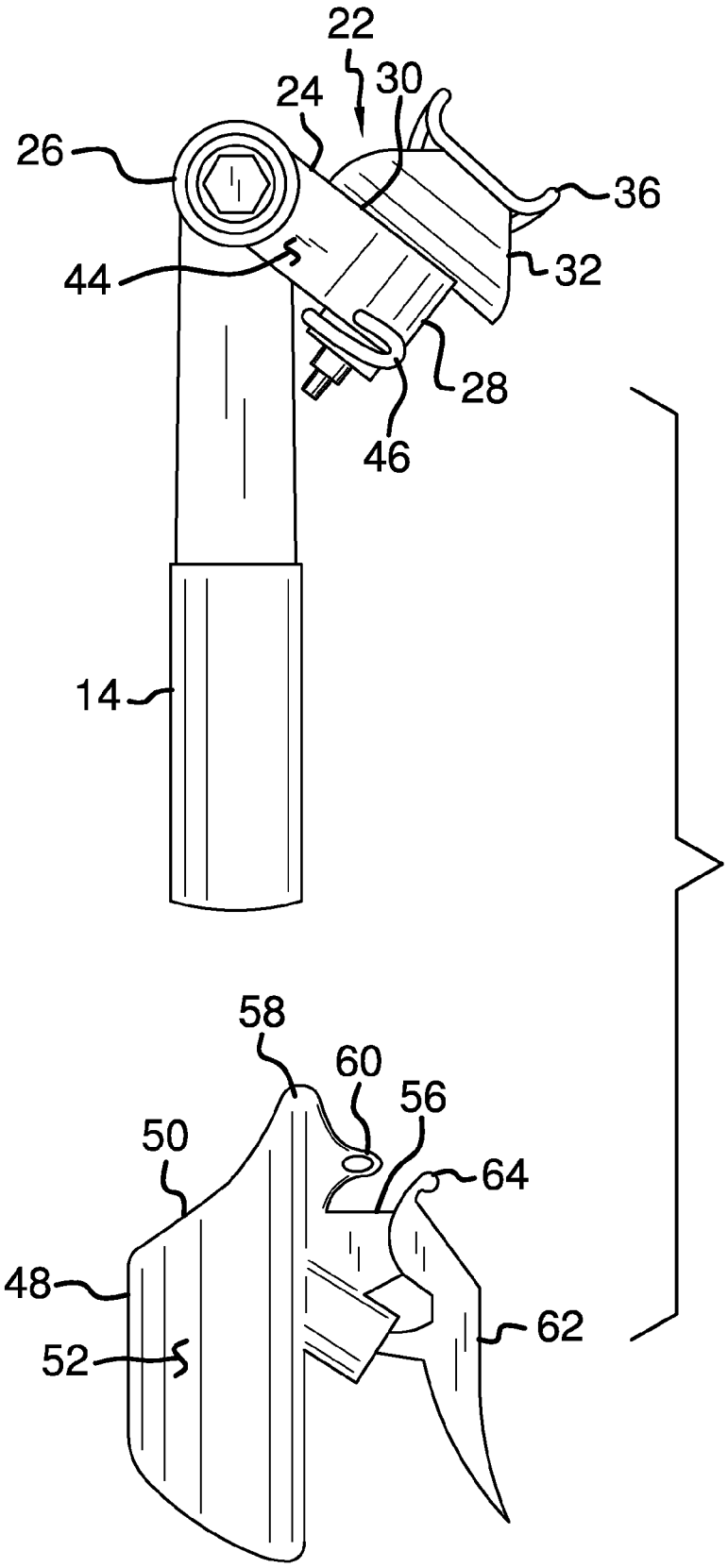
FIG. 1 is a left side view of a holder assembly according to an embodiment of the disclosure.
Figure 2:
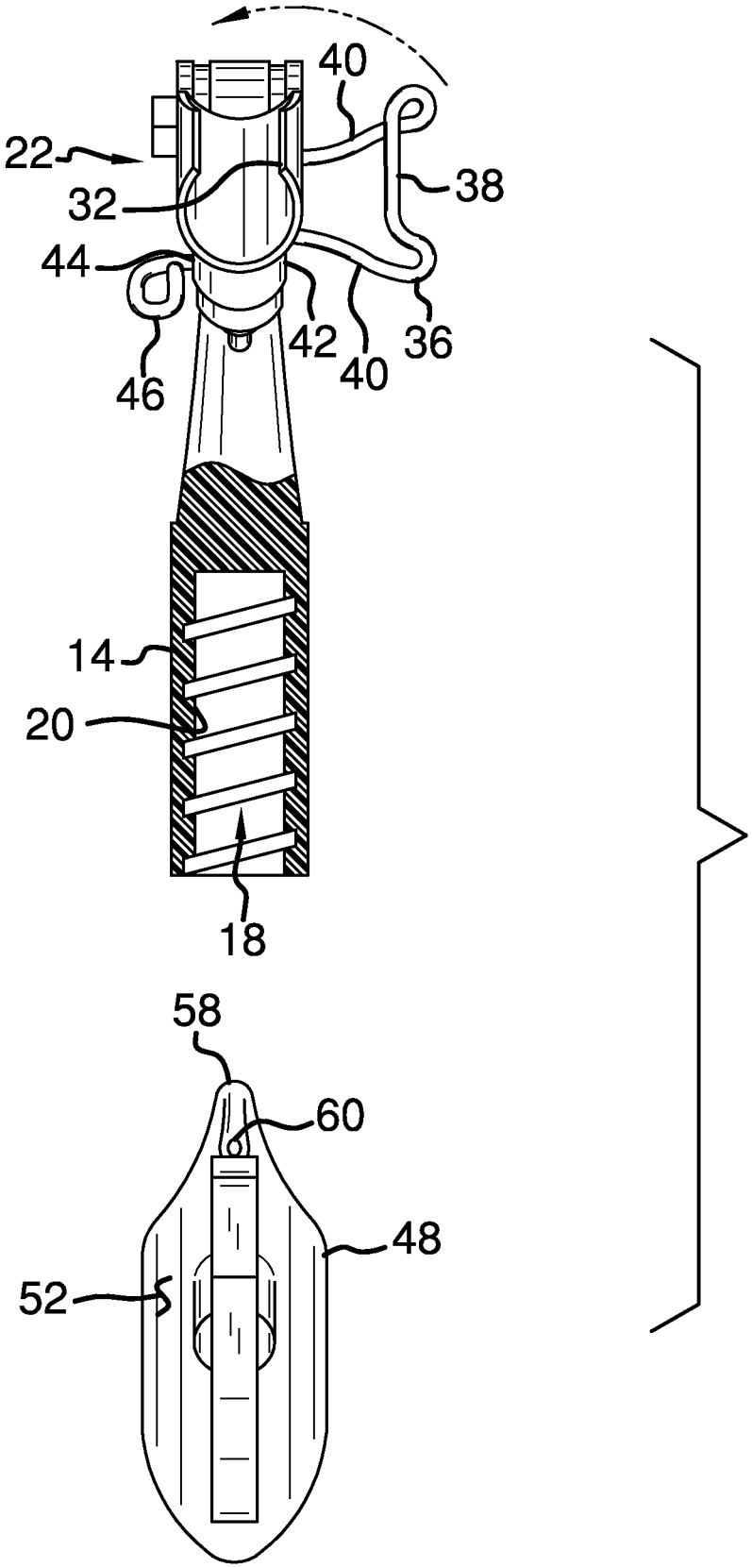
FIG. 2 is a front view of an embodiment of the disclosure.
Figure 3:
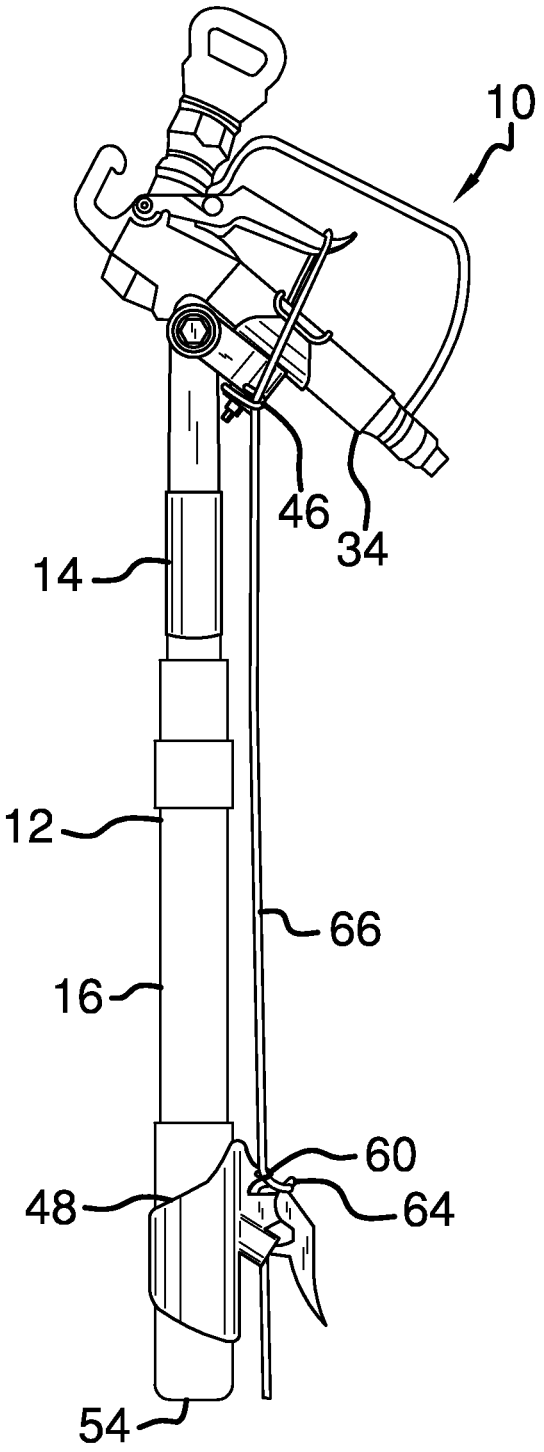
FIG. 3 is a perspective view of an embodiment of the disclosure.
Figure 4:
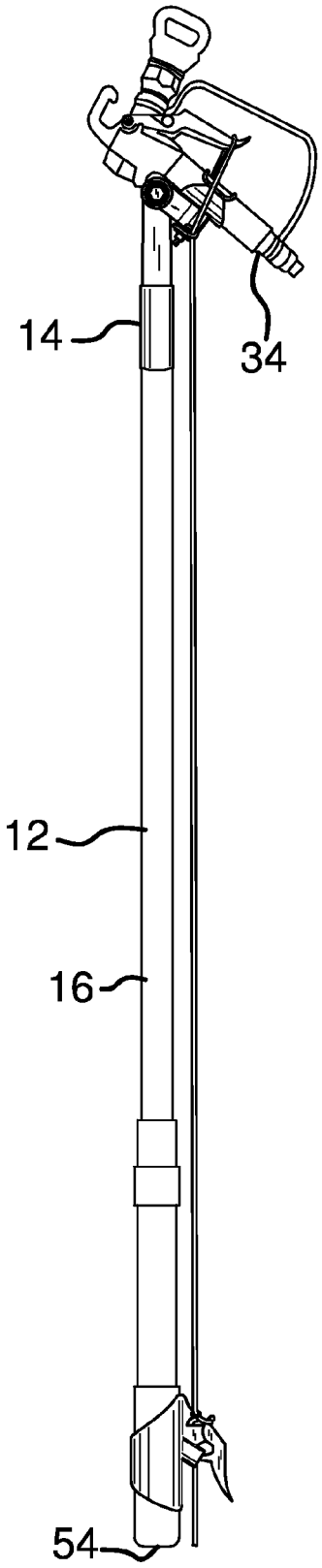
FIG. 4 is an in-use view of an embodiment of the disclosure.

With reference now to the drawings, and in particular to FIGS. 1 through 4 thereof, a new holder device embodying the principles and concepts of an embodiment of the disclosure and generally designated by the reference numeral 10 will be described.

As best illustrated in FIGS. 1 through 4, the holder assembly 10 generally comprises a pole 12. The pole 12 has an upper section 14 and a lower section 16. The upper section 14 has a well 18 extending upwardly therein. A bounding surface 20 of the well 18 is threaded so upper section 14 may threadably engage the lower section 16. The lower section 16 has a telescopically adjustable length.

An engaging member 22 is provided. The engaging member 22 comprises a mount 24 that has a first end 26, a second end 28 and a top surface 30. The first end 26 is rotatably coupled to the upper section 14 such that the mount 24 is positionable at a selected angle with respect to the pole 12.

A saddle 32 is coupled to the top surface 30 of the mount 24. The saddle 32 may receive a paint gun 34 such that the paint gun 34 is retained on the pole 12. The paint gun 34 may be a pneumatic paint gun of any conventional design.

A clip 36 is provided. The clip 36 has a central section 38 and a pair of lateral sections 40 coupled to and extending away therefrom. The mount 24 has a first lateral surface 42 extending between the first 26 and second 28 ends. The clip 36 is movably coupled to the first lateral surface 42. The clip 36 is positionable in a closed position such that the clip 36 extends across the saddle 32 to retain the paint gun 34 within the saddle 32. The clip 36 is positionable in an open position such that clip 36 extends laterally away from the mount 24 to allow the paint gun 34 to be removed from the saddle 32.

The mount 24 has a second lateral surface 44 extending between the first 26 and second ends 28. A guide 46 is coupled to the second lateral surface 44 of the mount 24. The guide 46 is shaped into a pig-tail.

A connector 48 is provided. The connector 48 has an inner surface 50 and an outer surface 52. The connector 48 is coupled to the pole 12 such that the connector 48 is positioned proximate a distal end 54 of the pole 12 with respect to the engaging member 22. The connector 48 has a first tab 56 coupled to and extending outwardly from the outer surface 52. The connector 48 has a top edge 58. Additionally, the connector 48 has a loop 60 extending outwardly from the outer surface 52 such that the loop 60 is positioned proximate the top edge 58.

A trigger 62 is movably coupled to the first tab 56 on the connector 48. The trigger 62 has a second tab 64 coupled thereto. A cord 66 is coupled to and extends between the second tab 64 on the trigger 62 and the paint gun 34. The cord 66 extends through the loop 60 and the guide 46 to actuate the paint gun 34 when the trigger 62 is actuated.

In use, the lower section 16 of the pole 12 is adjusted to a selected length. The pole 12 is manipulated to position the paint gun 34 proximate an area that would otherwise be at an unreachable height. The trigger 62 is actuated, actuating the paint gun 34 to paint the area.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A holder assembly configured to retain a paint gun on an extension pole, said assembly comprising:

a pole having an upper section and a lower section, said upper section having a well extending upwardly therein, a bounding surface of said well being threaded, wherein said upper section threadably engages said lower section;

an engaging member coupled to said upper section, said engaging member being configured to retain on said pole a paint gun having a paint gun trigger configured to actuate said paint gun when squeezed;

a connector coupled to said pole such that said connector is positioned proximate a distal end of said pole with respect to said engaging member, said connector having an inner surface, an outer surface, and a top edge;

a holder trigger movably coupled to said connector; and a cord extending outside of said pole between the engaging member and said holder trigger such that the cord extends over the paint gun trigger, said cord being configured such that when said holder trigger is actuated, said cord is pulled toward the connector, thereby squeezing said paint gun trigger, thereby actuating said paint gun.

2. The assembly according to claim 1, wherein said engaging member comprises a mount having a first end, a second end and a top surface, said first end being rotatably coupled to said upper section such that said mount is positionable at a selected angle with respect to said pole, said mount having a first lateral surface extending between said first and second ends.

3. The assembly according to claim 2, wherein said engaging member further comprises a saddle coupled to said top surface of said mount, said saddle being configured to receive the paint gun such that the paint gun is retained on said pole.

4. The assembly according to claim 3, wherein said engaging member further comprises a clip having a central section and a pair of lateral sections coupled to and extending away therefrom, said clip being movably coupled to said first lateral surface.

5. The assembly according to claim 4, wherein said clip is positionable in a closed position such that said clip extends across said saddle, thereby retaining the paint gun within said saddle, and wherein said clip is positionable in an open position such that clip extends laterally away from said mount, thereby allowing the paint gun to be removed from said saddle.

6. The assembly according to claim 1, further comprising:

a mount having a first end, a second end, and a second lateral surface extending between said first and second ends; and a guide coupled to said second lateral surface of said mount.

7. The assembly according to claim 1, said connector having a loop extending outwardly from said outer surface such that said loop is positioned proximate said top edge, wherein the cord extends through the loop.

8. The assembly according to claim 1, said holder trigger having a second tab coupled thereto.

9. The assembly according to claim 8, further comprising:

a loop coupled to and extending from said connector;

a mount; and a guide coupled to and extending from said mount;

and wherein said cord is coupled to said second tab on said holder trigger, said cord extending through said loop and said guide.

10. A holder assembly configured to retain a paint gun on an extension pole, said assembly comprising:

a pole having an upper section and a lower section, said upper section having a well extending upwardly therein, a bounding surface of said well being threaded wherein said upper section threadably engages said lower section;

an engaging member, said engaging member comprising:

a mount having a first end, a second end and a top surface, said first end being rotatably coupled to said upper section such that said mount is positionable at a selected angle with respect to said pole, said mount having a first lateral surface extending between said first and second ends, said mount having a second lateral surface extending between said first and second ends;

a saddle coupled to said top surface of said mount, said saddle being configured to receive a paint gun and retain said paint gun on said pole, said paint gun having a paint gun trigger configured to actuate said paint gun when squeezed;

a clip having a central section and a pair of lateral sections coupled to and extending away therefrom, said clip being movably coupled to said first lateral surface of said mount, said clip being positionable in a closed position such that said clip extends across said saddle, thereby retaining the paint gun within said saddle, said clip being positionable in an open position such that clip extends laterally away from said mount, thereby allowing the paint gun to be removed from said saddle, and a guide coupled to said second lateral surface of said mount;

a connector having an inner surface and an outer surface, said connector being coupled to said pole such that said connector is positioned proximate a distal end of said pole with respect to said engaging member, said connector having a first tab coupled to and extending outwardly from said outer surface, said connector having a top edge, said connector having a loop extending outwardly from said outer surface such that said loop is positioned proximate said top edge;

a holder trigger movably coupled to said connector, said holder trigger having a second tab coupled thereto; and a cord extending outside of said pole between said second tab on said holder trigger and the engaging member, said cord extending through said loop and said guide and across the paint gun trigger, said cord being configured such that when said holder trigger is actuated, said cord is pulled towards the connector, thereby squeezing said paint gun trigger, thereby actuating said paint gun.

* * * * *